US009843146B1

(12) United States Patent
Chen

(10) Patent No.: US 9,843,146 B1
(45) Date of Patent: Dec. 12, 2017

(54) LIGHTED OUTLET

(71) Applicant: Liang Light Chen, Los Gatos, CA (US)

(72) Inventor: Liang Light Chen, Los Gatos, CA (US)

(73) Assignee: Six Sights Corporation, Campbell, CA (US)

( * ) Notice: Subject to any disclaimer, the term of this patent is extended or adjusted under 35 U.S.C. 154(b) by 0 days.

(21) Appl. No.: 15/471,409

(22) Filed: Mar. 28, 2017

Related U.S. Application Data

(63) Continuation-in-part of application No. 15/387,129, filed on Dec. 21, 2016.

(51) Int. Cl.
*H01R 13/717* (2006.01)
*H01R 25/00* (2006.01)

(52) U.S. Cl.
CPC ..... *H01R 13/7172* (2013.01); *H01R 13/7175* (2013.01); *H01R 25/006* (2013.01)

(58) Field of Classification Search
CPC ..... H01R 13/7175; H01R 13/6658; H01R 25/006; H01R 13/6641; H01R 13/717; H01R 2103/00; H01R 13/518; H01R 23/7073
USPC ..... 439/490, 76.1, 535, 540.1, 541.5
See application file for complete search history.

(56) References Cited

U.S. PATENT DOCUMENTS 5,383,799 A * 1/1995 Fladung ..... H01R 25/006 439/108
7,736,174 B2 * 6/2010 Bhosale ..... F21V 33/00 365/95
8,105,094 B2 * 1/2012 Patel ..... H01Q 1/2233 439/535
9,444,175 B2 9/2016 Chen
2004/0219823 A1 * 11/2004 Greene ..... H01R 13/465 439/488
2009/0035967 A1 * 2/2009 Weeks ..... H01R 13/4534 439/93
2009/0141477 A1 * 6/2009 Bhosale ..... F21V 33/00 362/95
2011/0045689 A1 * 2/2011 Tsai ..... G06F 1/18 439/490
2011/0104919 A1 * 5/2011 Patel ..... H01Q 1/2233 439/137
2013/0023147 A1 * 1/2013 Zien ..... H01R 25/003 439/490
2013/0267116 A1 * 10/2013 Tin ..... H02J 1/00 439/535

* cited by examiner

*Primary Examiner* — Gary Paumen
(74) *Attorney, Agent, or Firm* — Douglas L. Weller

(57) ABSTRACT

A lighted outlet system has a circuit mounted on a printed circuit board. The circuit includes a light source that emits light. An outlet is mounted on the printed circuit board over the circuit. The outlet includes an outlet core composed of transparent or clear material. The outlet core serves as a light pipe for light emitted from the light source. Housing houses the outlet core.

20 Claims, 10 Drawing Sheets

LIGHTED OUTLET

BACKGROUND

Outlets, also referred to as electrical outlets, power outlets or socket connectors, when connected to power serve as power conduits for appliances. Outlets can provide either Alternating Current (AC) or Direct Current (DC). For example, C13 outlets (female) and C14 appliance inlet (males) are frequently used with computer and computer related peripherals.

DESCRIPTION OF THE EMBODIMENT

Figure 1:
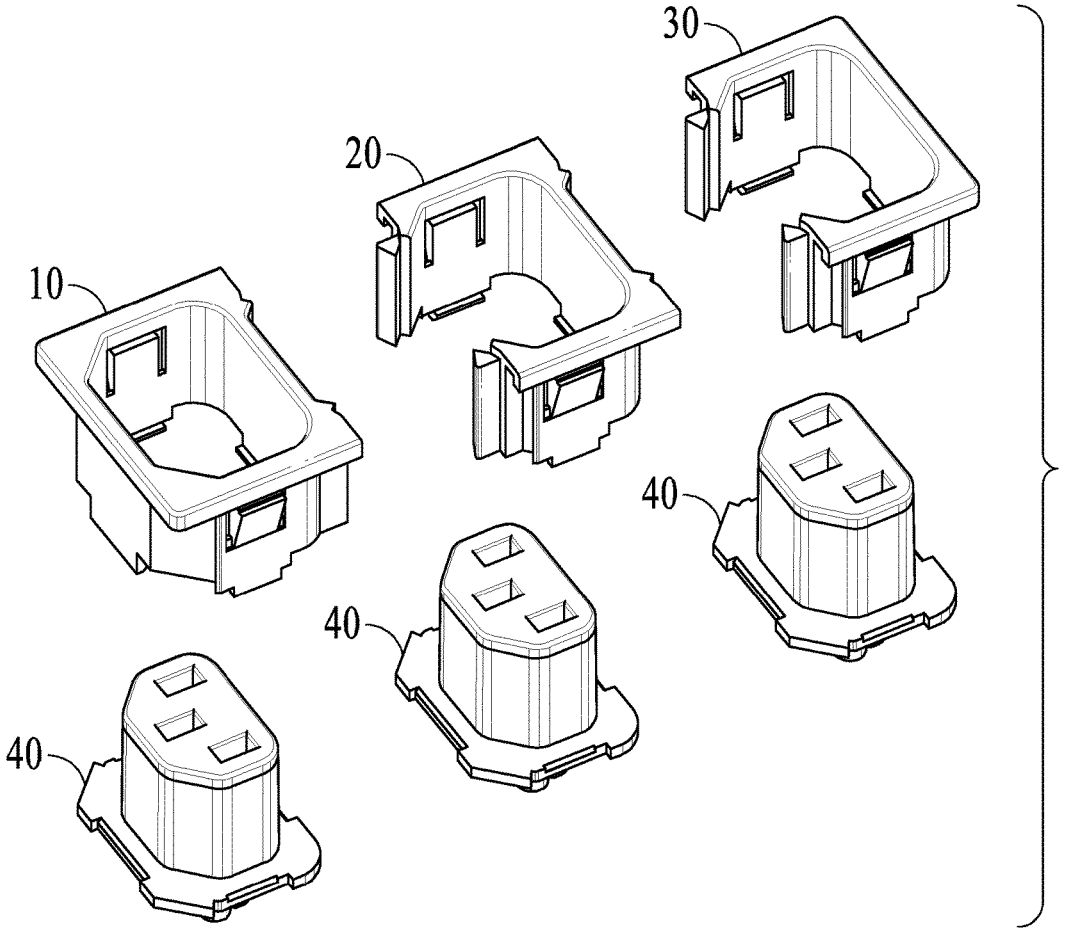
FIG. 1 shows a module outlet before assembly in accordance with an embodiment.

FIG. 1 shows base module housing 10, middle module housing 20, end module housing 30 and outlet cores 40 ready to be assembled into a module outlet. For example, each of outlet cores 40 is a C13 connector as specified by standards of International Electrotechnical Commission (IEC) 60320. Alternatively, each outlet core is another type of outlet compatible with another IEC standard or compatible with a standard from another standards organization or a special custom configuration. The outlets described herein are generally used as power outlets.

Figure 2:
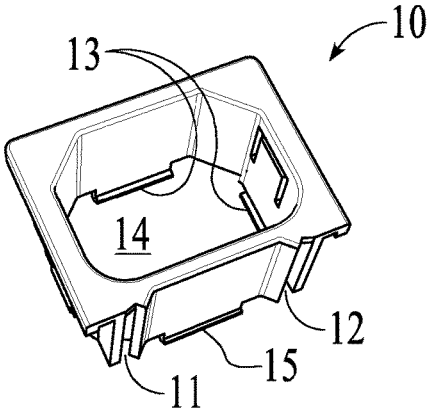
FIG. 2 and FIG. 3 show various views of base module housing for a single outlet core of a module outlet in accordance with an embodiment.
Figure 3:
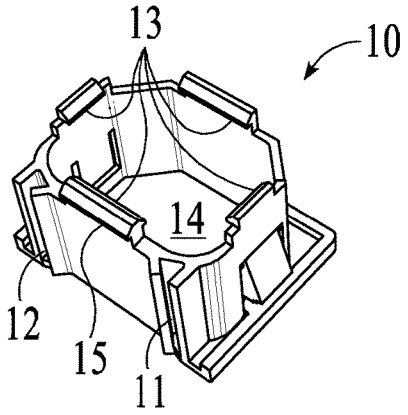

FIG. 2 and FIG. 3 show details of base module housing 10. An opening 14 is ready to receive an outlet core 40, which is placed in through a bottom of base module housing 10. Tabs 13 are used to lock outlet core 40 into place. A dovetail groove 11 and a dovetail groove 12 are configured to receive dovetail tongues from another module housing when building a module outlet. Base module housing 10 is configured so that it can be used in a stand-alone module outlet, or can be used as one end of a module outlet assembled with other module housing to form a module outlet with multiple outlets.

Figure 4:
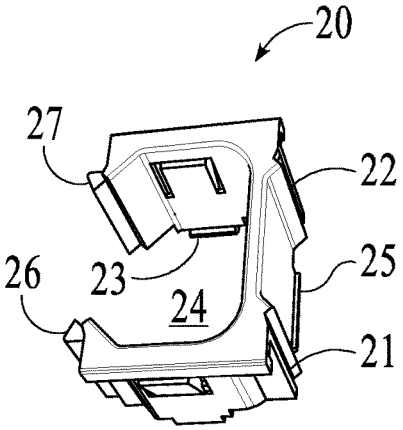
FIG. 4 shows middle module housing for a single outlet core of a module outlet in accordance with an embodiment.

FIG. 4 shows details of middle module housing 20. An opening 24 is ready to receive an outlet core 40, which is placed in through a bottom of middle module housing 20. Tabs 23 are used to lock outlet core 40 into place. A dovetail groove 21 and a dovetail groove 22 are configured to receive dovetail tongues from another module housing when building a module outlet. A dovetail tongue 26 and a dovetail tongue 27 are configured to be placed in dovetail grooves of from another module housing when building a module outlet.

Figure 5:
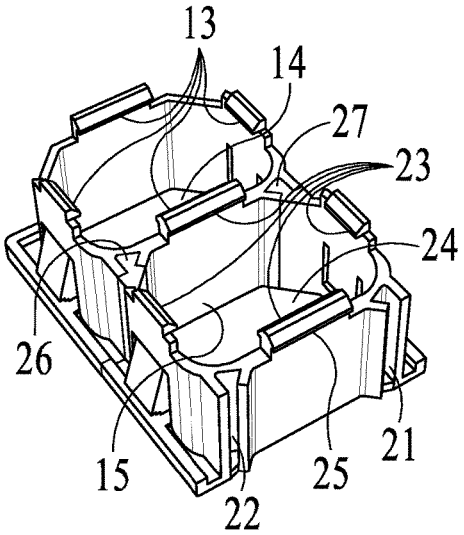
FIG. 5 shows the base module housing shown in FIGS. 2 and 3 joined with the middle module housing shown in FIG. 4 in accordance with an embodiment.

FIG. 5 shows base module housing 10 assembled with middle module housing 20. Dovetail tongue 26 of middle module housing 20 has been slid into dovetail groove 11 of base module housing 10. Dovetail tongue 27 of middle module housing 20 has been slid into dovetail groove 12 of base module housing 10. As shown in FIG. 5, a tab 15 of base module housing 10 is now configured so that when an outlet core 40 is placed within opening 24 of middle module housing 20, tab 15 of base module housing 10 is used with tabs 23 of middle module housing 20 to lock the outlet core 40 into place.

Figure 6:
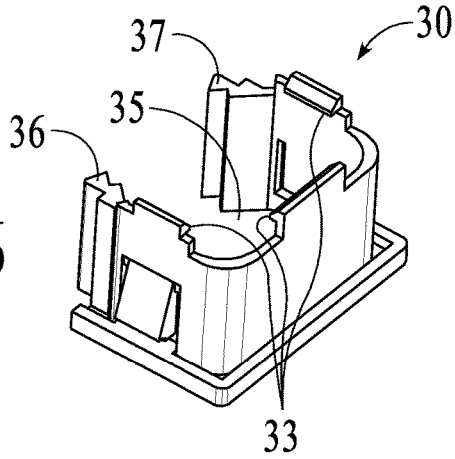
FIG. 6 shows end module housing for a single outlet core of a module outlet in accordance with an embodiment.

FIG. 6 shows details of end module housing 30. An opening 35 is ready to receive an outlet core 40, which is placed in through a bottom of end module housing 30. Tabs 33 are used to lock outlet core 40 into place. A dovetail tongue 36 and a dovetail tongue 37 are configured to be placed in dovetail grooves of from another module housing when building a module outlet.

Figure 7:
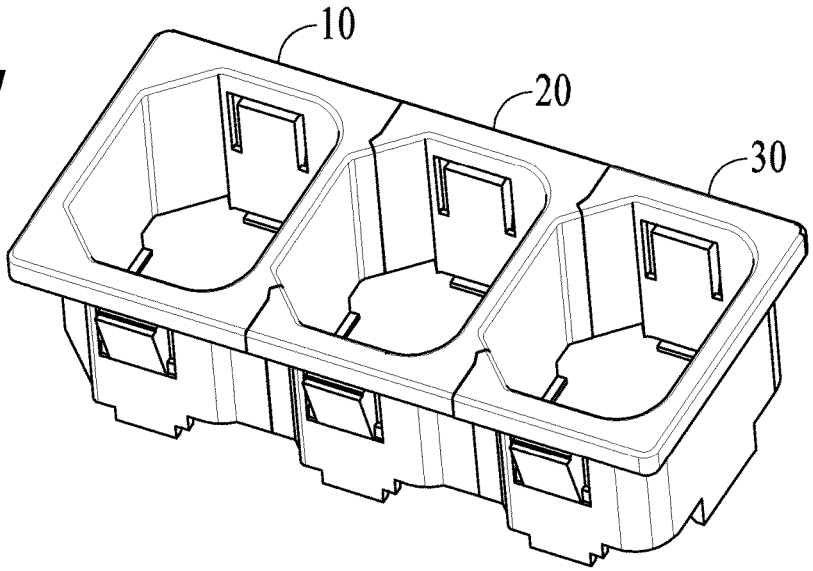
FIG. 7 shows the base module housing shown in FIGS. 2 and 3 joined with the middle module housing shown in FIG. 4 and the end module housing shown in FIG. 6 in accordance with an embodiment.

FIG. 7 shows end module housing 30 assembled with middle module housing 20 and base module housing 10 into housing for a module outlet. When assembled, dovetail tongue 36 of end module housing 30 is slid into dovetail groove 21 of middle module housing 20. Dovetail tongue 37 of end module housing 30 has been slid into dovetail groove 22 of middle module housing 20. A tab 25 of middle module housing 20 is configured so that when an outlet core 40 is placed within opening 35 of end module housing 30, tab 25 of middle module housing 20 is used with tabs 33 of end module housing 30 to lock the outlet core 40 into place.

While FIG. 7 shows three module housing parts assembled together, any number of module housing parts can be assembled together. For example, end module housing 30 can be joined directly to base module housing 10 to form a module outlet with two-outlets. For example, a module outlet with four-outlets can be formed by assembling two of middle module housing 20 between end module housing 30 and base module housing 10. For example, a module outlet with five-outlets can be formed by assembling three of middle module housing 20 between end module housing 30 and base module housing 10. And so on.

Figure 8:
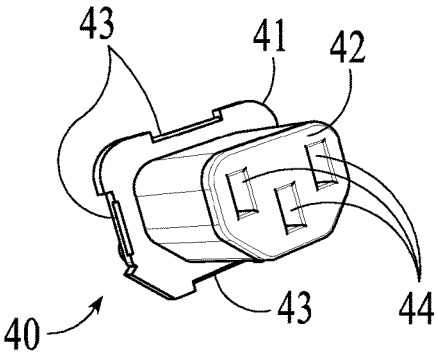
FIG. 8 and FIG. 9 show various views of a single outlet core of a module outlet in accordance with an embodiment.

FIG. 8 shows details of outlet core 40. Outlet core 40 includes plug receptors 44 in a body 42 of outlet core 40. When outlet core 40 is assembled into base module housing 10, body 42 of outlet core 40 is placed up through opening 14 in outlet core 40. A lip 41 prevents outlet core 40 from traveling out the top of opening 14. Tabs 13 of module housing lock around lip 41 at tab reception areas 43. This keeps outlet core 40 securely in base module housing 10.

Figure 9:
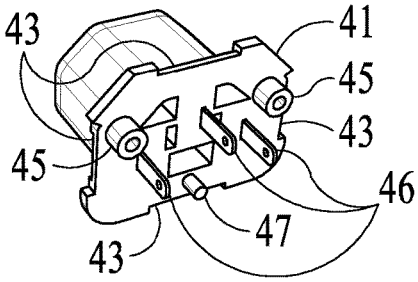

FIG. 9 shows leads 46 of outlet core 40 ready to establish electrical connection with a printed circuit board or other mounting destination of the module outlet. Support guides 45 and support guide 47 are used to support the assembled module outlet when the module outlet is mounted on a printed circuit board or other mounting destination of the module outlet.

Figure 10:
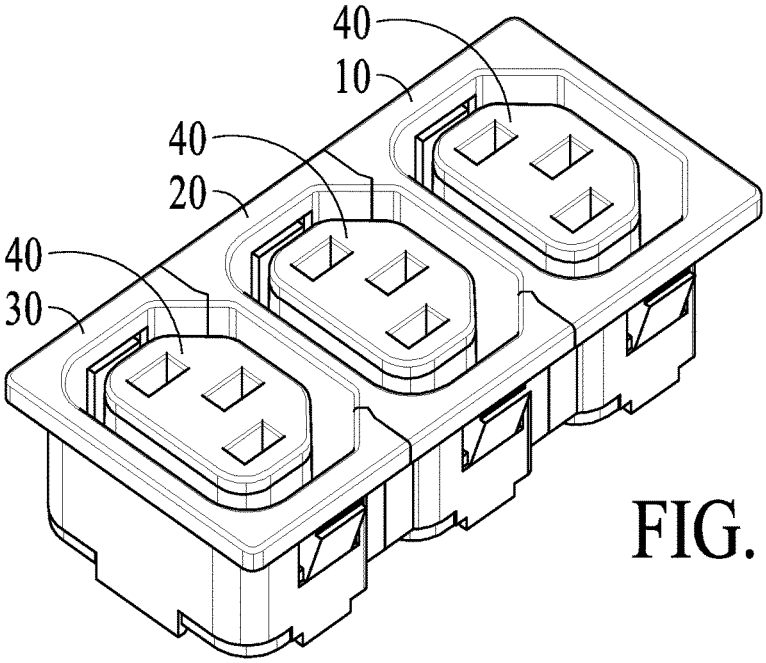
FIG. 10 and FIG. 11 how various views of a module outlet after assembly in accordance with an embodiment.
Figure 11:
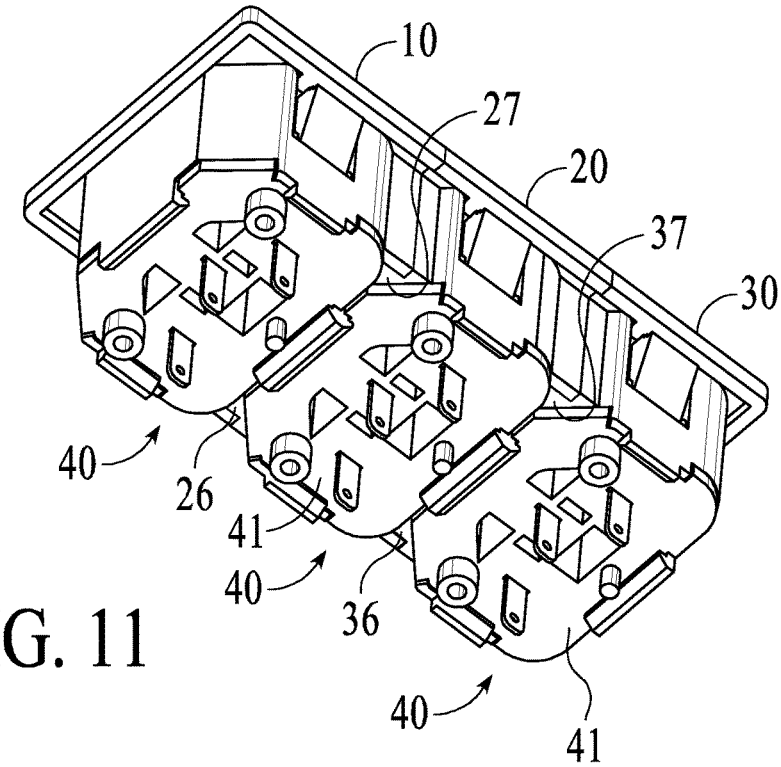

FIG. 10 and FIG. 11 show end module housing 30 assembled with middle module housing 20 and base module housing 10. For the outlet core 40 within opening 24 of middle module housing 20, lip 41 prevents outlet core 40 from traveling out the top of opening 24. Tabs 23 of middle module housing 20 and tab 15 of base module housing 10 lock around lip 41 at tab reception areas 43. This keeps outlet core 40 securely in middle module housing 20. Also, lip 41 partially covers dovetail tongue 26 of middle module housing 20 and dovetail groove 11 of base module housing 10, as well as dovetail tongue 27 of middle module housing 20 and dovetail groove 12 of base module housing 10. This locks dovetail tongue 26 within dovetail groove 11 and dovetail tongue 27 within dovetail groove 12, thus locking middle module housing 20 to base module housing 10. This assures stability of the housing of the module outlet when it is fully assembled.

Likewise, for the outlet core 40 within opening 35 of end module housing 30, lip 41 prevents outlet core 40 from traveling out the top of opening 35. Tabs 33 of end module housing 30 and tab 25 of middle module housing 20 lock around lip 41 at tab reception areas 43. This keeps outlet core 40 securely in end module housing 30. Also, lip 41 partially covers dovetail tongue 36 of end module housing 30 and dovetail groove 21 of middle module housing 20, as well as dovetail tongue 37 of end module housing 30 and dovetail groove 22 of middle module housing 20. This locks dovetail tongue 36 within dovetail groove 21 and dovetail tongue 37 within dovetail groove 22, thus locking middle module housing 20 to base module housing 10. This assures stability of the housing of the module outlet when it is fully assembled.

Figure 12:
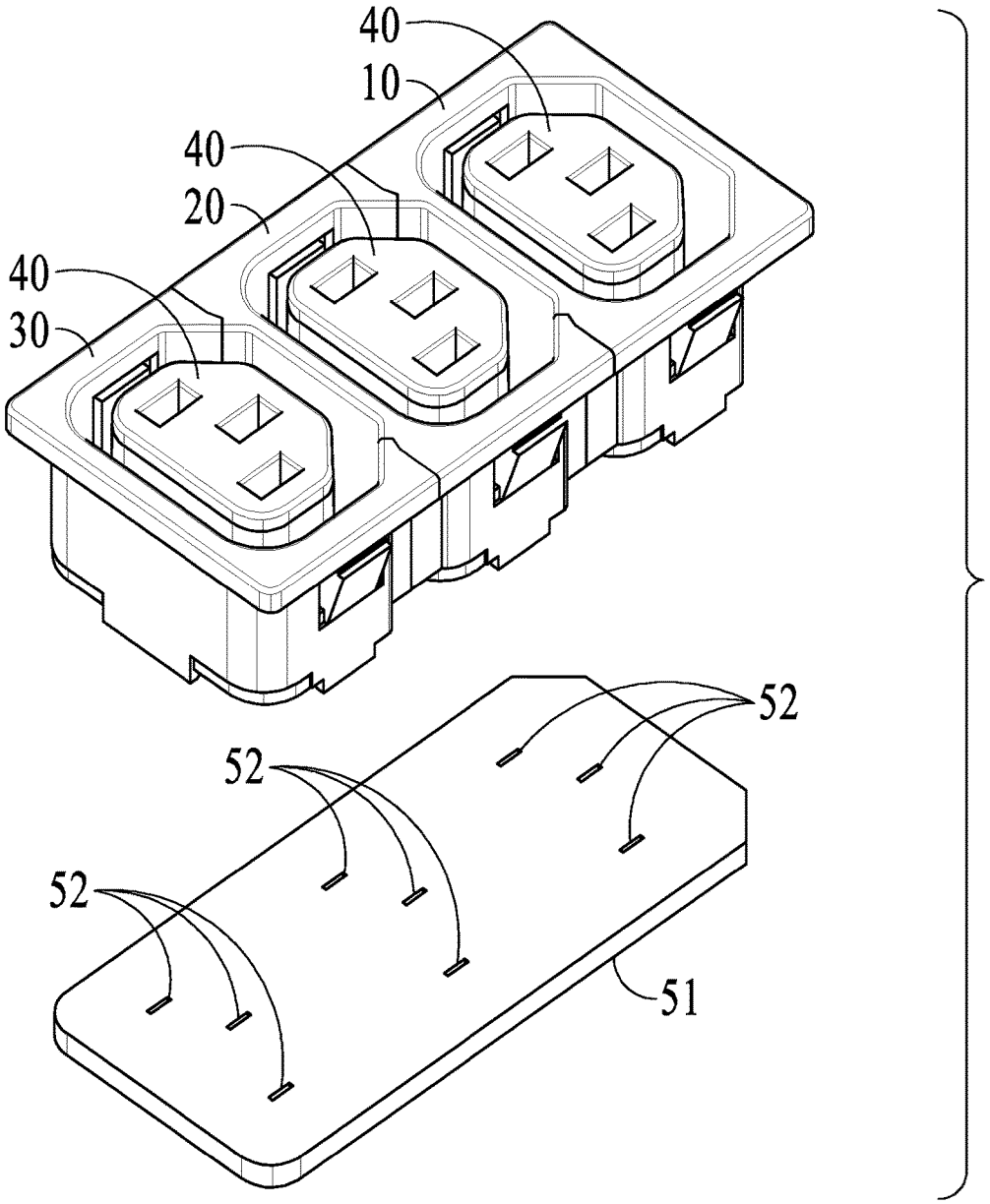
FIG. 12 and FIG. 13 show various views of a module outlet before placement on a printed circuit board in accordance with an embodiment.
Figure 13:
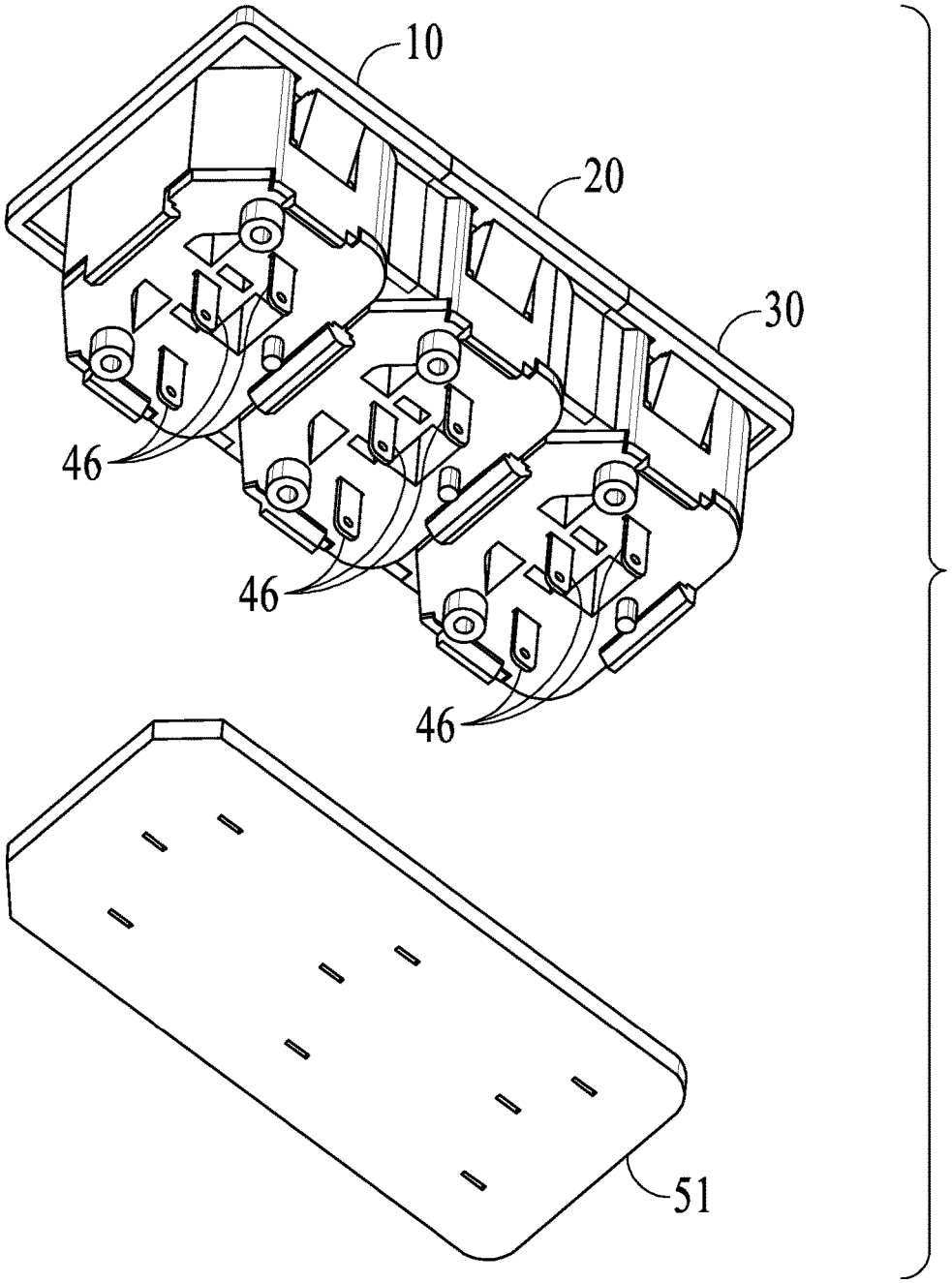

FIG. 12 and FIG. 13 show the assembled module outlet ready to be assembled onto a printed circuit board 51. Leads 46 of outlet cores 40 are placed in lead receptacles 52 on printed circuit board 51. Printed circuit board 51 can be sized to be assembled just with a module outlet, or printed circuit board 51 can be designed to be of sufficient size to receive other circuitry in addition to a module outlet.

Figure 14:
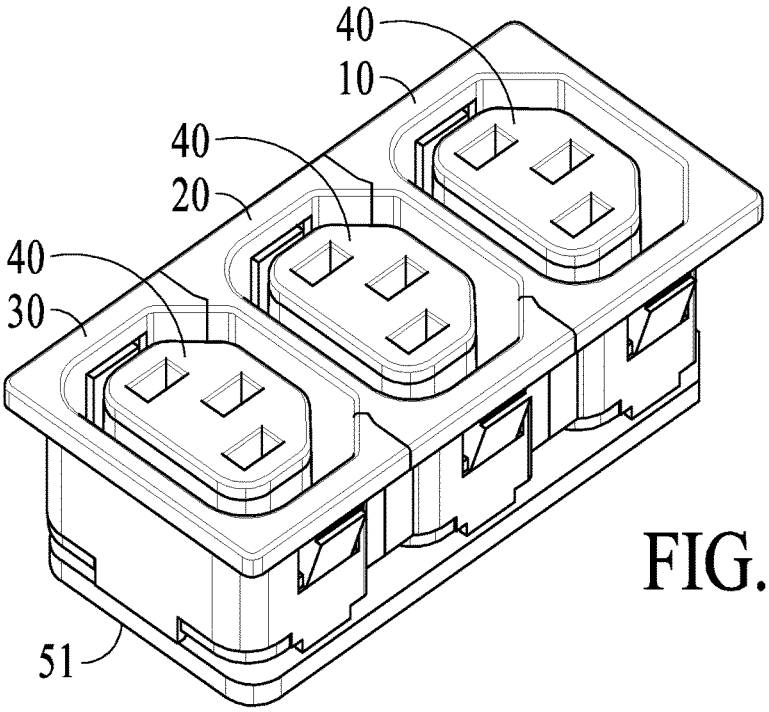
FIG. 14 shows a module outlet after placement on a printed circuit board in accordance with an embodiment.

FIG. 14 shows the assembled module outlet mounted onto printed circuit board 51.

Figure 15:
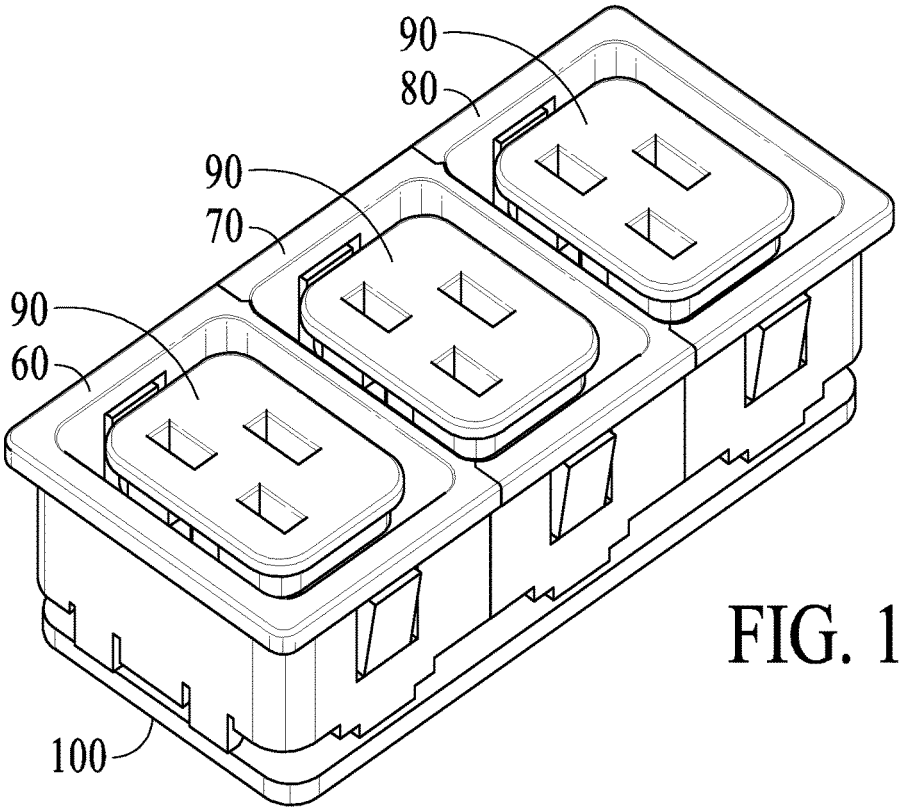
FIG. 15 shows a module outlet after placement on a printed circuit board in accordance with another embodiment.

Connectors other than C13 connector can serve as the basis of a module outlet. For example, FIG. 15 shows base module housing 60, middle module housing 70, end module housing 80 and outlet cores 90 assembled into a module outlet mounted on a printed circuit board 100. For example, each of outlet cores 90 is a C19 connector as specified by standards of International Electrotechnical Commission (IEC) 60320. Alternatively, each outlet core is another type of outlet compatible with another IEC standard or compatible with a standard from another standards organization or a special custom configuration.

Figure 16:
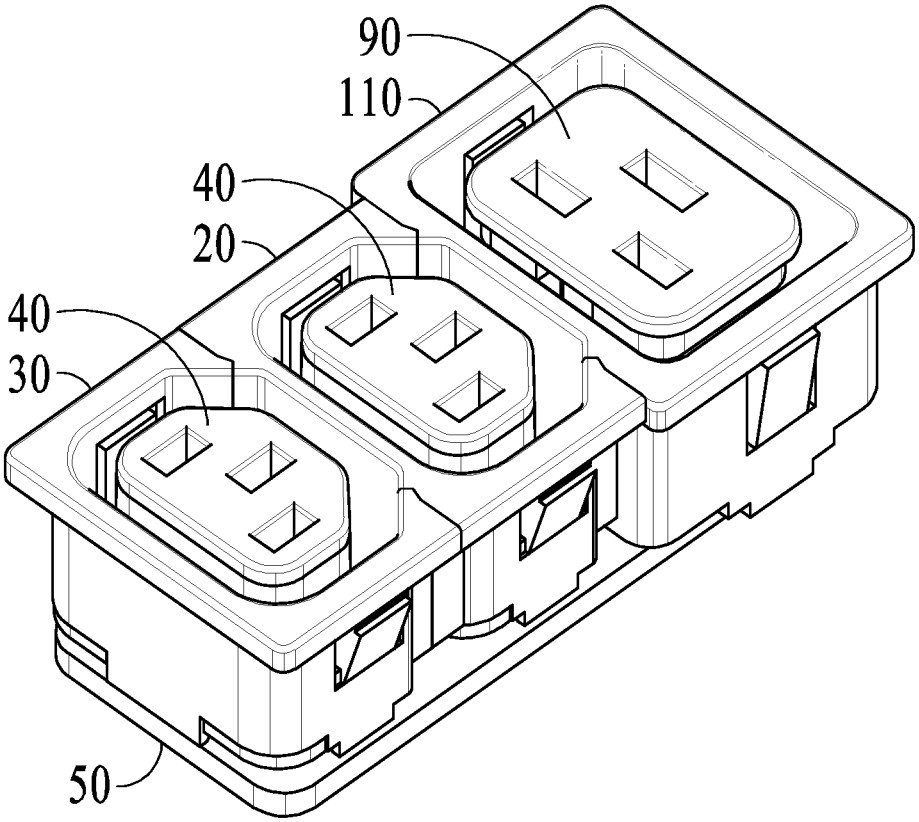
FIG. 16 shows a module outlet after placement on a printed circuit board in accordance with another embodiment.

Different types of connectors also can be assembled into a module outlet. For example, FIG. 16 shows base module housing 110, middle module housing 20, end module housing 30, outlet cores 40 and an outlet core 90 assembled into a module outlet mounted on printed circuit board 50. For example, each of outlet cores 40 is a C13 connector and outlet core 90 is a C19 connector as specified by standards of International Electrotechnical Commission (IEC) 60320. Alternatively, one or more of the outlet cores is another type of outlet compatible with another IEC standard or compatible with a standard from another standards organization.

Figure 17:
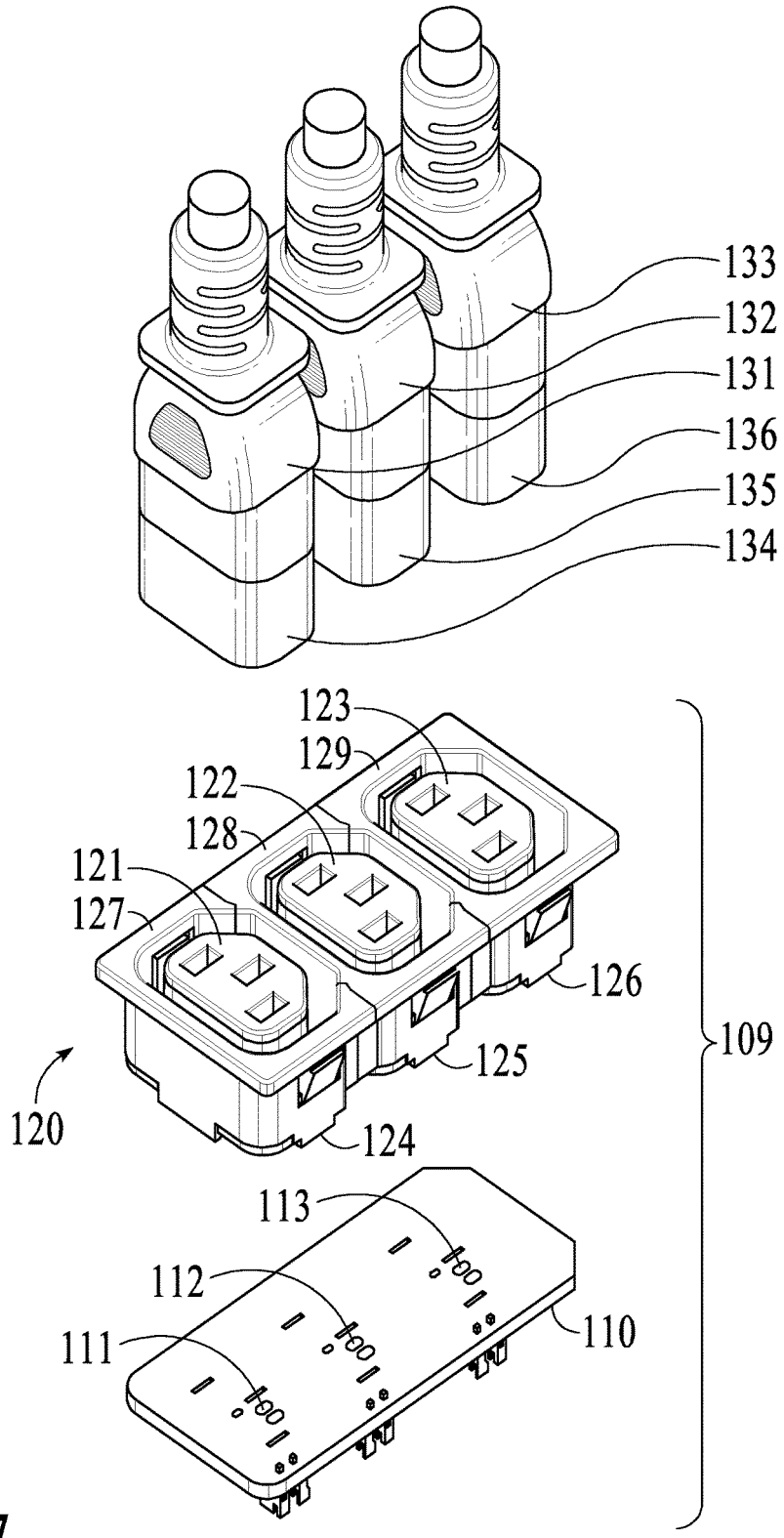
FIG. 17 and FIG. 18 show a lighted module outlet in accordance with another embodiment.

FIG. 17 illustrates how any of the module outlets described herein can be lighted to indicate outlet electrical status or lighted for any other purpose. A module outlet includes a printed circuit board 110. Mounted on printed circuit board 110 are circuits 111, circuits 112 and circuits 113. Each of circuits 111, circuits 112 and circuits 113 include light emitting diodes (LEDs) or another type of light source.

Each of circuits 111, 112 and 113 can include LEDs with different colors so that the color of a lighted LED indicates status of an associated outlet. For example, color of light can indicate whether or not power is available from the outlet, whether or not current being drawn from the outlet is within a normal range, working status of a device powered by the outlet or a warning condition such as an overload condition, a low voltage condition, a high voltage condition. Other status conditions can be communicated based on a particular need or configuration.

Housing 120 can consist of separate module housing 127, module housing 128 and module housing 129. For example, module housing 127, module housing 128 and module housing 129 have solid color outer walls that serve as a light barrier so that light information from each module is prevented from interfering with light information from other modules. For example, housing 120 is composed of plastic, metal, rubber or another solid color material suitable to make module housing. For example, each of module housing 127, module housing 128 and module housing 129 are a different color than the other module housings. Alternatively, housing 120 can be composed of transparent or clear material. Alternative to separate module housing, housing 120 can be integrated in a single piece of material.

An outlet core body 121, an outlet core body 122 and an outlet core body 123 are each made from clear or transparent material that serves as a light pipe from LEDs on circuits 111, 112 and 113. For example, each of outlet core body 121, outlet core body 122 and outlet core body 123 is made from transparent material of a different color.

Alternatively, each of outlet core body 121, outlet core body 122 and outlet core body 123 is made of clear material so that LEDs on circuit 111 control the appearance of color on outlet core body 121, LEDs on circuit 112 control the appearance of color on outlet core body 122 and LEDs on circuit 112 control the appearance of color on outlet core body 121. Clear material is particularly useful when circuits 111, 112 and 113 include LEDs with different colors where that the color of a lighted LED indicates status of an associated outlet. In this case, the clear material of outlet core body 121, outlet core body 122 and outlet core body 123 serve as light pipes providing color status information to a user or potential user of the outlet. For example, outlet core body 121, outlet core body 122 and outlet core body 123 are composed of plastic, glass or another clear or transparent material suitable to make an outlet core body.

An outlet plug 131, an outlet plug 132 and an outlet plug 133 are each shown ready to be plugged into an outlet of module outlet 109. A portion 134 of outlet plug 131 is made from clear or transparent material so that when outlet plug 131 is plugged in, light information originating from LEDs on circuit 111 and traveling through outlet core body 121 remains visible through the clear or transparent material of portion 134 of outlet plug 131 even when outlet plug 131 is plugged into an outlet of module outlet 109.

Likewise, a portion 135 of outlet plug 132 is made from clear or transparent material so that when outlet plug 132 is plugged in, light information originating from LEDs on circuit 112 and traveling through outlet core body 122 remains visible through the clear or transparent material of portion 135 of outlet plug 132 even when outlet plug 132 is plugged into an outlet of module outlet 109. A portion 136 of outlet plug 133 is made from clear or transparent material so that when outlet plug 133 is plugged in, light information originating from LEDs on circuit 113 and traveling through outlet core body 123 remains visible through the clear or transparent material of portion 136 of outlet plug 133 even when outlet plug 133 is plugged into an outlet of module outlet 109. For example, portion 134 of outlet plug 131, portion 135 of outlet plug 132, portion 136 of outlet plug 133 are composed of plastic, glass or another clear or transparent material suitable to make a portion of an outlet plug.

In the example shown in FIG. 17, module outlet 109 has three outlets. This is only exemplary as a lighted module outlet can also have one outlet, two outlets, four outlets, or any number of outlets depending on a desired configuration.

Figure 18:
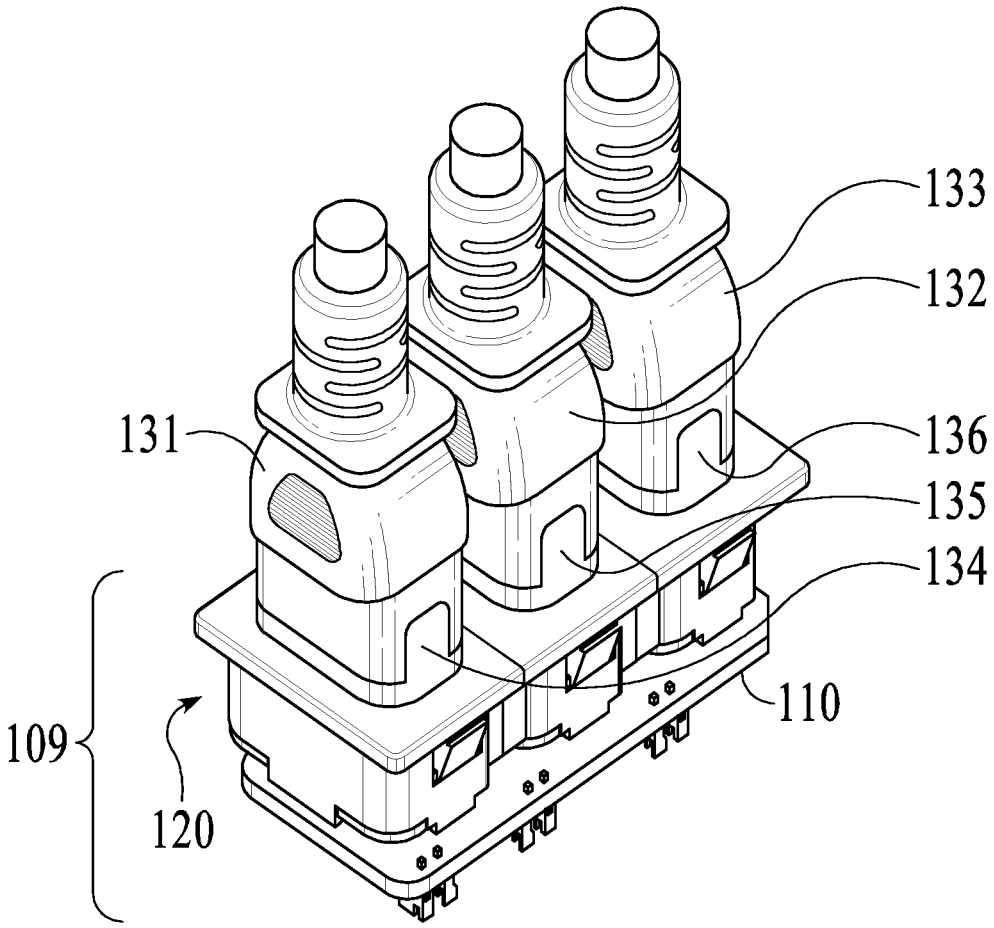

FIG. 18 shows outlet plug 131, outlet plug 132 and outlet plug 133 each plugged into an outlet of module outlet 109. Light information originating from LEDs on circuit 111 and traveling through outlet core body 121 remains visible through the clear or transparent material of portion 134 of outlet plug 131. Likewise, light information originating from LEDs on circuit 112 and traveling through outlet core body 122 remains visible through the clear or transparent material of portion 135 of outlet plug 132. Light information originating from LEDs on circuit 113 and traveling through outlet core body 123 remains visible through the clear or transparent material of portion 136 of outlet plug 133.

The foregoing discussion discloses and describes merely exemplary methods and embodiments. As will be understood by those familiar with the art, the disclosed subject matter may be embodied in other specific forms without departing from the spirit or characteristics thereof. Accordingly, the present disclosure is intended to be illustrative, but not limiting, of the scope of the invention, which is set forth in the following claims.

What is claimed is:

1. A lighted module outlet system comprising:
- a printed circuit board;
- a first circuit mounted on the printed circuit board, the first circuit including a first light source that emits light;
- a first outlet mounted on the printed circuit board over the first circuit, the first outlet including:
  - a first outlet core composed of transparent or clear material, the first outlet core serving as a light pipe for light emitted from the first light source, and
  - first housing that houses the first outlet core; and,
- a second circuit mounted on the printed circuit board, the second circuit including a second light source that emits light;
- a second outlet mounted on the printed circuit board over the second circuit, the second outlet including:
  - a second outlet core composed of transparent or clear material, the second outlet core serving as a light pipe for light emitted from the second light source, and
  - second housing that houses the second outlet core.

2. A lighted module outlet system as in claim 1, additionally comprising:
- a third circuit mounted on the printed circuit board, the third circuit including a third light source that emits light;
- a third outlet mounted on the printed circuit board over the third circuit, the third outlet including:
  - a third outlet core composed of transparent or clear material, the third outlet core serving as a light pipe for light emitted from the third light source, and
  - third housing that houses the third outlet core.

3. A lighted module outlet system as in claim 1, additionally comprising:
- an outlet plug, the outlet plug including a portion composed of transparent or clear material located so that when outlet plug is plugged in to the first outlet, some of light emitted from the first circuit and traveling through the first outlet core is visible through the portion of the outlet plug that is composed of transparent or clear material.

4. A lighted module outlet system as in claim 1 wherein the first light source comprises a light emitting diode and the second light source comprises a light emitting diode.

5. A lighted module outlet system as in claim 1 wherein a color of light emitted by the first light source indicates a status of the first outlet, and wherein a color of light emitted by the second light source indicates a status of the second outlet.

6. A lighted module outlet system as in claim 5 wherein the status of the first outlet as indicated by the first light source is at least one of the following:
- whether current being drawn from the outlet is within a normal range;
- working status of a device powered by the first outlet;
- a warning condition.

7. A lighted module outlet system as in claim 6, wherein the warning condition is at one of the following:
- an overload condition;
- a low voltage condition;
- a high voltage condition.

8. A lighted module outlet system as in claim 1, wherein color of the first housing is a different color than color of the second housing.

9. A lighted module outlet system as in claim 1:
- wherein the first outlet core is composed of transparent having a first color;
- wherein the second outlet core is composed of transparent having a second color;
- wherein the first color is different color than the second color.

10. A lighted module outlet system as in claim 1, additionally comprising:
- a first outlet plug, the first outlet plug including a portion composed of transparent material having a first color; and,
- a second outlet plug, the second outlet plug including a portion composed of transparent material having a second color;
- wherein the first color is a different color than the second color.

11. A lighted module outlet system as in claim 1, wherein the first outlet core is a C13 connector, a C19 connector as specified by standards of International Electrotechnical Commission (IEC) 60320, or a custom configuration not specified by standards of International Electrotechnical Commission (IEC) 60320.

12. A lighted module outlet system as in claim 1, wherein the first housing is composed of solid color material and the second housing is composed of solid color material.

13. A lighted outlet system comprising:
- a printed circuit board;
- a circuit mounted on the printed circuit board, the circuit including a light source that emits light;

an outlet mounted on the printed circuit board over the circuit, the outlet including:

an outlet core composed of transparent or clear material, the outlet core serving as a light pipe for light emitted from the light source, and housing that houses the outlet core.

14. A lighted outlet system as in claim 13, additionally comprising:

an outlet plug, the outlet plug including a portion composed of transparent or clear material located so that when outlet plug is plugged in to the outlet, some of light emitted from the circuit and traveling through the outlet core is visible through the portion of the outlet plug that is composed of transparent or clear material.

15. A lighted outlet system as in claim 13, wherein the light source comprises a light emitting diode.

16. A lighted outlet system as in claim 13, wherein a color of light emitted by the light source indicates a status of the outlet.

17. A lighted outlet system as in claim 16 wherein the status of the outlet as indicated by the light source is at least one of the following:

whether current being drawn from the outlet is within a normal range;

working status of a device powered by the outlet;

a warning condition.

18. A lighted outlet system as in claim 17, wherein the warning condition is at one of the following:

an overload condition;

a low voltage condition;

a high voltage condition.

19. A lighted outlet system as in claim 13, wherein the outlet core is a C13 connector or a C19 connector as specified by standards of International Electrotechnical Commission (IEC) 60320.

20. A lighted outlet system as in claim 13, wherein the outlet core is a custom configuration not specified by standards of International Electrotechnical Commission (IEC) 60320.

* * * * *